United States Patent [19]

Raudabaugh et al.

[11] Patent Number: 4,473,034

[45] Date of Patent: Sep. 25, 1984

[54] INSULATED HEATER MODULE

[75] Inventors: James H. Raudabaugh, Cedar Rapids, Iowa; Joseph A. Godrick, Wellesley, Mass.

[73] Assignee: Amana Refrigeration, Inc., Amana, Iowa

[21] Appl. No.: 541,500

[22] Filed: Oct. 13, 1983

[51] Int. Cl.[3] ..... F22B 5/02

[52] U.S. Cl. ..... 122/18; 122/14; 122/19; 122/367 C

[58] Field of Search ..... 122/18, 19, 14, 161, 122/155 R, 333, 362, 367 C

[56] References Cited

U.S. PATENT DOCUMENTS 4,338,888 7/1982 Gerstmann et al. ..... 122/18 X 4,413,590 11/1983 Landreau ..... 122/18

*Primary Examiner*—Edward G. Favors

*Attorney, Agent, or Firm*—William R. Clark; Joseph D. Pannone

[57] ABSTRACT

A heater module having a cylindrical heat exchanger surrounding a central cavity and burner wherein an end manifold is covered with a layer of insulation to reduce the temperature differential between the outer annular trough of the manifold and the inner central flat disk which covers the end of the cavity. The annular trough and the disk are stamped from a unitary piece of plate steel. Without the insulation, the disk would heat to a temperature much higher than the annular trough because the trough communicates with tubes of the heat exchanger and contains recirculating liquid. By reducing the temperature differential, less strain is put on the end manifold as a result of nonuniform expansion.

12 Claims, 7 Drawing Figures

FIG. 4
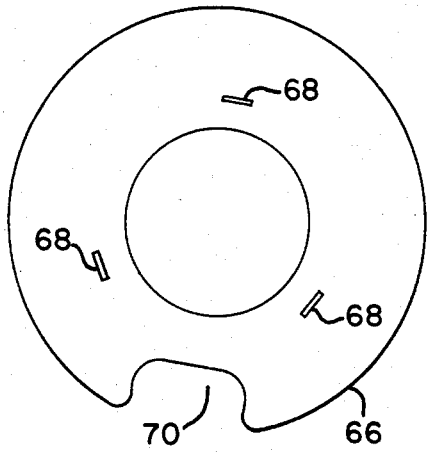
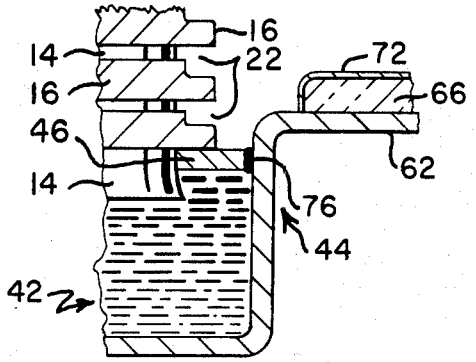
FIG. 7
FIG. 5
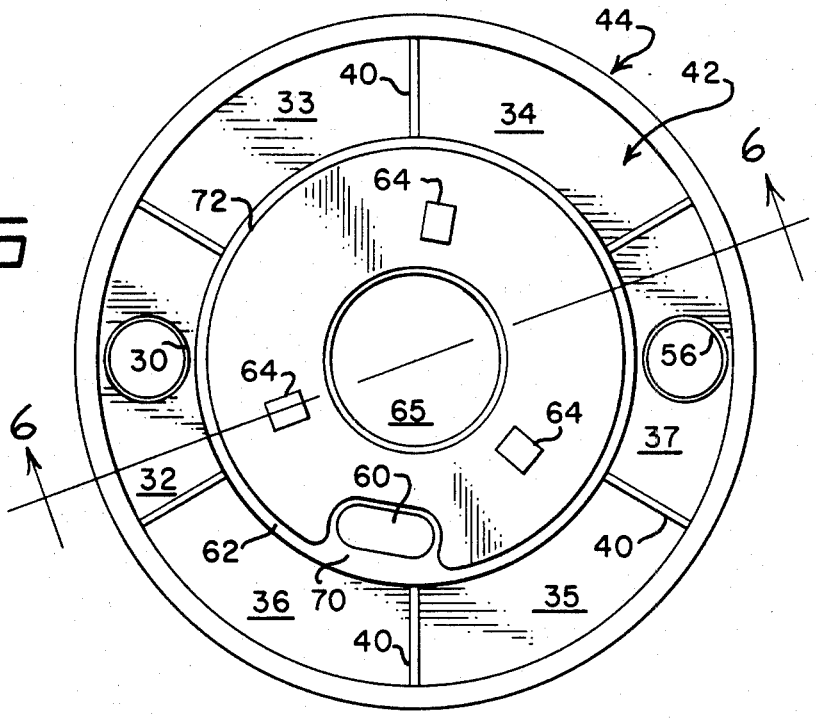
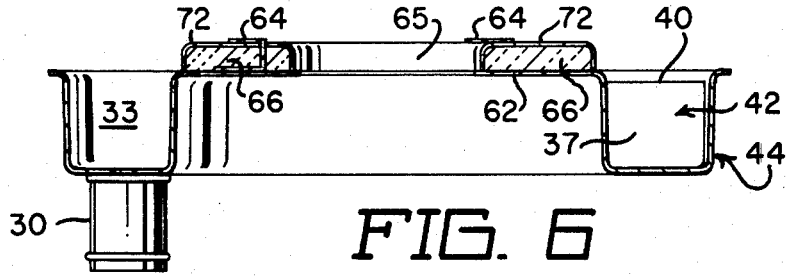
FIG. 6

INSULATED HEATER MODULE

BACKGROUND OF THE INVENTION

Heater modules having an outer cylindrical heat exchanger and a burner positioned in a central cavity thereof have been used in the prior art. These heater modules may have end manifolds that have chambers for circulating a liquid back and forth through tubes in the heat exchanger. For example, each chamber may have two or more tubes communicating with it and the liquid from the opposite end enters the chamber from one tube and returns through the other. In other words, the chamber function as elbow conduits for two tubes or sets of tubes. In one such heater module, the manifold at one end is manufactured by stamping a unitary piece of steel such that there is a flat inner area that covers the end of the central cavity and a peripheral trough. The chambers are formed in the trough by attaching radial baffles therein. An annular plate with apertures for the tubes covers the trough and the structure so formed is made water tight by copper plating and brazing. In the flat inner area or disk, there is a circular opening through which the burner inserts into the cavity. The hot gases of combustion from the burner then pass outwardly through the central cavity and flow through the heat exchanger. Manifolds such as described above may be subject to cracking at or near the region where the annular plate attaches to the trough.

SUMMARY OF THE INVENTION

The invention defines a heater module comprising a heat exchanger having a plurality of substantially parallel tubes surrounding a cavity, the tubes being integrally connected by metal fins, the cavity having at least one open end, a manifold covering the one open end wherein the manifold comprises a metal disk having an outer annular trough communicating with the tubes for circulating a liquid therebetween, a gas burner positioned in the cavity for providing hot gases of combustion which flow outwardly through the fins to transfer heat to the liquid in the tubes and a layer of thermal insulation covering at least a portion of the disk to limit the thermal differential between the disk and the trough of the manifold. The disk and the trough may be formed by stamping a unitary plate of steel. The layer may preferably comprise ceramic fiber and may be at least partically covered by a jacket of stainless steel. Also, the trough may preferably be partitioned into a plurality of chambers by radial baffles such that there are at least two tubes associated with each chamber wherein one tube directs water into the chamber and the other tube carries the water back to the opposite end of the heater module. The object of the layer of thermal insulation is to minimize the temperature differential or $\Delta T$ between the disk and the trough. If $\Delta T$ is too high, such as, for example, on the order of 150° F, plastic deformation could result at or near the juction between the two because they expand nonuniformly and an annular plate brazed into the trough makes it structurally rigid. Plastic deformation could cause cyclic or cycle fatigue resulting in cracking of the manifold or failure of the braze joint.

The invention may also be practiced by a heater module comprising a substantially cylindrical heat exchanger having a concentric cavity, the exchanger comprising a plurality of axially-aligned parallel tubes integrally connected with metal fins, first and second manifolds respectively covering the ends of the cavity, the first manifold comprising a unitary disk and peripheral annular trough, the tubes communicating with the trough wherein a liquid is circulated through the trough and the tubes, a gas burner axially positioned in the cavity for providing hot gases of combustion which flow outwardly through spaces between the fins and the tubes of the heat exchanger to transfer heat to the liquid circulating in the tubes, and a layer of thermal insulation covering at least a portion of the side of the disk facing the cavity, the layer limiting the temperature differential between the disk and the trough to reduce cycle fatigue of the manifold. Further, it may be preferable that the insulation layer and jacket be secured to the disk by a plurality of metal mounting tabs that are connected to the disk and insert through slots in the layer and the jacket and are bent outwardly against the jacket.

The invention may further define a heater module comprising a substantially cylindrical heat exchanger having an open axial region defining a central cylindrical cavity, the exchanger comprising metal fins and at least one tube in heat transfer relationship with the fins for circulating a liquid therethrough, first and second manifolds respectively covering the ends of the cylindrical cavity, the first manifold comprising a disk having a peripheral region bent to form an annular channel, the tube communicating with the channel, a tubular burner axially positioned in the central cylindrical cavity for providing hot gases of combustion which flow outwardly through the fins of the exchanger to transfer heat to the liquid in the tube, and a layer of thermal insulation covering at least a portion of the disk on the side facing the cavity to limit the temperature differential between the disk and the channel during operation of the burner thereby limiting the cyclic fatigue of the manifold caused by non-continuous operation of the burner.

The invention may further be practiced by a heater module comprising a heat exchanger matrix comprising a plurality of parallel tubes substantially arranged in a circle to form a cylinder having a central cylindrical cavity, the matrix further comprising metal fins integrally connected to the tubes in heat transfer relationship therewith, first and second manifolds respectively covering the ends of the central cylindrical cavity, the first manifold defining a disk having a central circular hole, the disk being substantially perpendicular to the tubes and having a unitary outer peripheral trough, the trough being covered with an annular apertured plate and having a plurality of baffles to form a plurality of chambers wherein the tubes are grouped into sets with each set selectively communicating through said plate apertures to one of said chambers, a tubular burner inserted through the circular hole in the disk and being positioned axially in the central cavity for providing hot gases of combustion which flow outwardly through spaces between the fins of the matrix to transfer heat to liquid flowing through the tubes, and a layer of thermally insulating material covering at least a portion of the disk on the side facing the cavity to limit the temperature differential between the disk and the trough thereby reducing plastic deformation of the manifold caused by on/off operation of the burner.

The invention further defines a heater module comprising a heat exchanger matrix comprising a plurality of parallel tubes substantially arranged in a circle to form a cylinder having a central cylindrical cavity, the matrix further comprising metal fins integrally connected to the tubes in heat transfer relationship therewith, first and second manifolds respectively covering the ends of the central cylindrical cavity, the first manifold defining a stamped plate metal structure having a substantially flat disk with a peripheral annular trough, the trough being partitioned into chambers by a plurality of radial baffles, the trough being covered by an annular plate having a plurality of circular apertures, the tubes inserting through the apertures wherein each of said chambers communicates with a selective set of the tubes for circulating a liquid through the matrix, the flat disk having a first hole for inserting a burner into said cavity, the burner providing hot gases of combustion which flow outwardly from the cavity through spaces between the fins and the tubes to transfer heat to the liquid in the tubes, the flat disk having a second hole peripherally located for inserting a burner ignitor into the cavity, the flat disk having a plurality of mounting tabs extending into the cavity, the tabs inserting through slots in a thermally insulating wafer and its metal cover and being bent outwardly to secure the wafer and the cover in place, the wafer and the cover having an aperture through which the burner is inserted and an edge notch through which the ignitor inserts, and the thermally insulating wafer limiting the temperature differential between the disk and the trough thereby reducing cyclic fatigue of the manifold resulting from nonuniform expansion during burner operating intervals.

BRIEF DESCRIPTION OF THE DRAWINGS

The foregoing objects and advantages and others will be more fully understood by reading the description of the preferred embodiment with reference to the drawings wherein:

FIG. 4 is a top view of the insulating wafer;

FIG. 5 is a view of the heater module taken along line 5—5 of FIG. 3 with the tabs bent down and without the ignitor;

FIG. 6 is a view taken along line 6—6 of FIG. 5; and

FIG. 7 is an illustrative drawing of a portion of the bottom manifold showing detail of the region of the trough and outer disk.

DESCRIPTION OF THE PREFERRED EMBODIMENT

Figure 1:
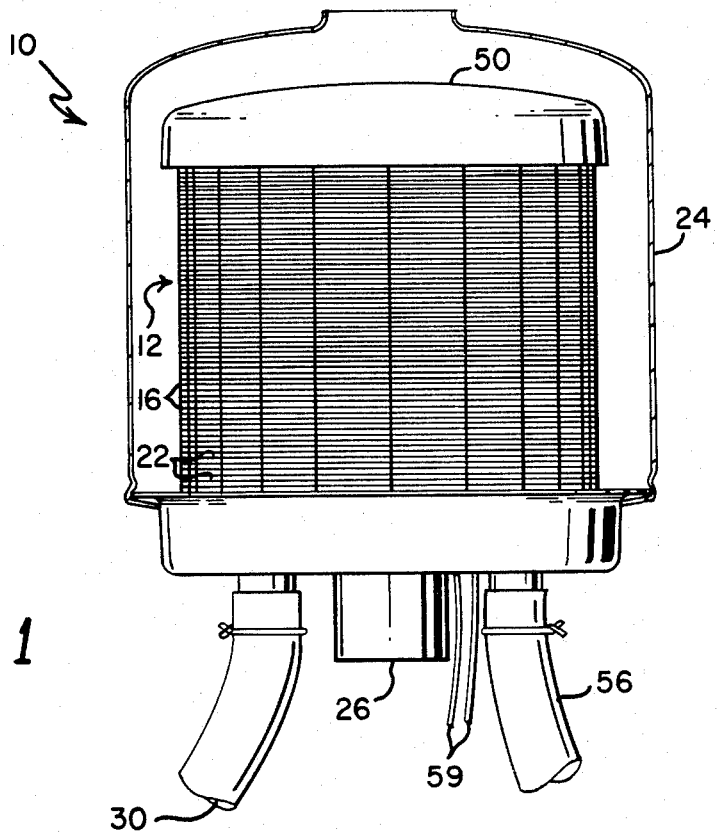
FIG. 1 is a front elevation view of a heater module including a broken away outer wrapper.
Figure 2:
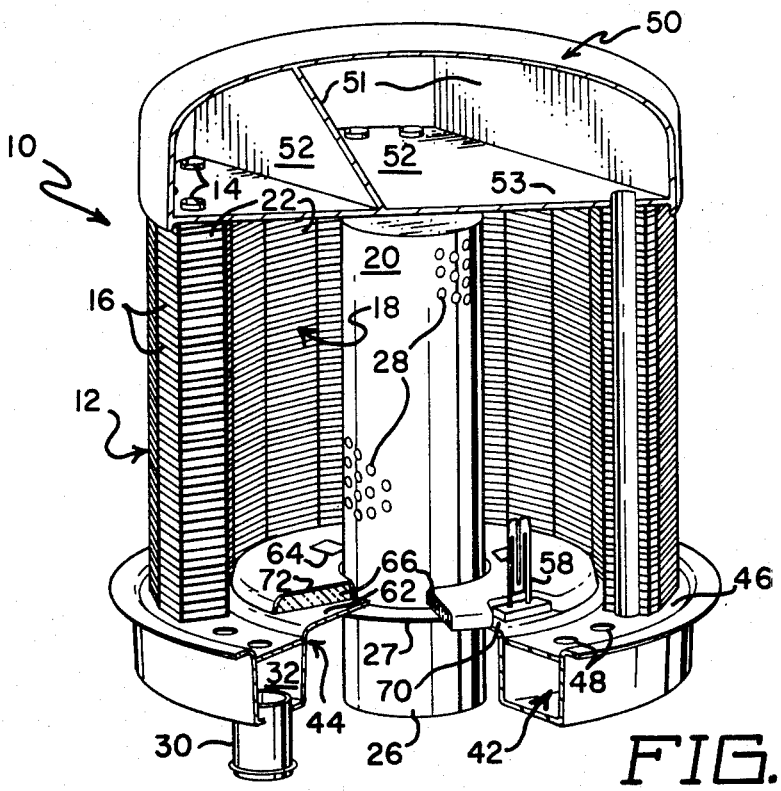
FIG. 2 is a perspective segmented view of the heater module of FIG. 1.
Figure 3:
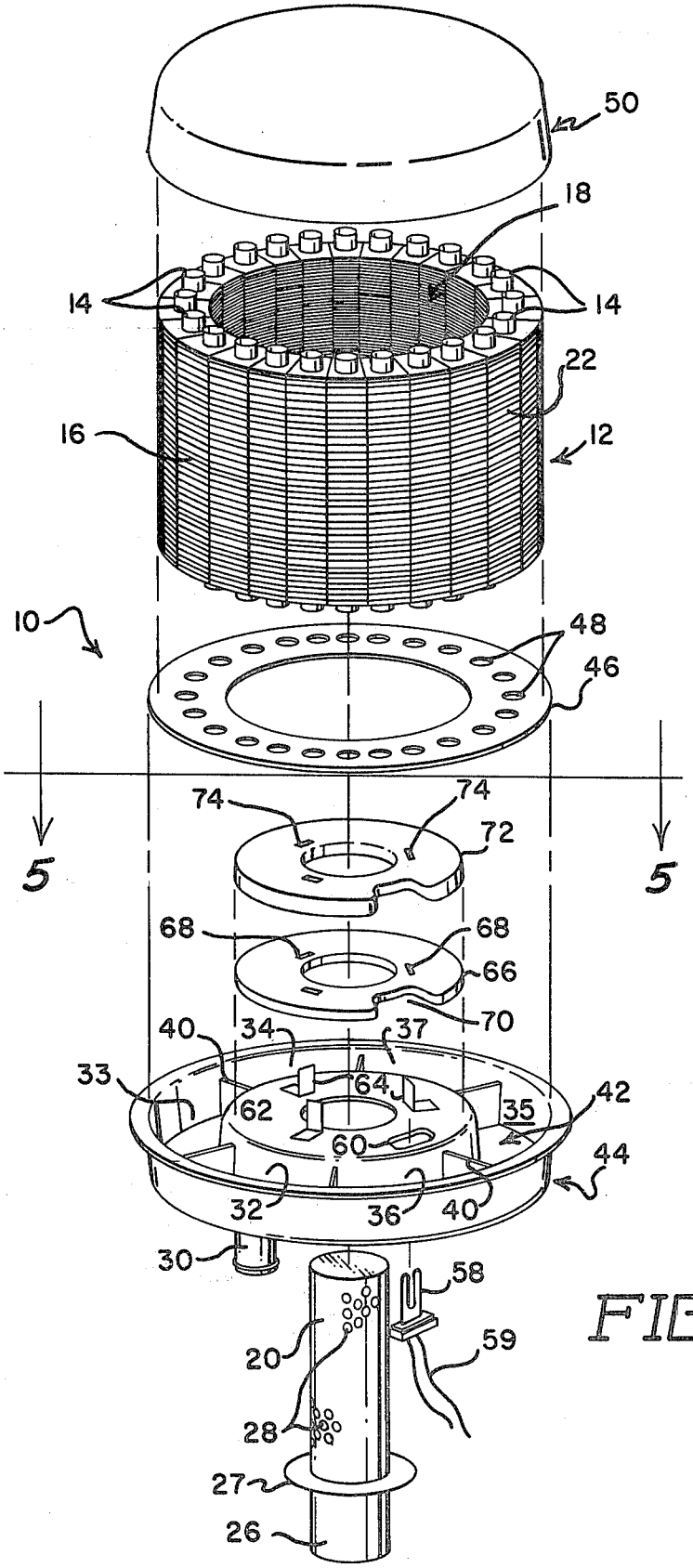
FIG. 3 is a perspective view of the heater module of FIG. 1 with the individual parts separated for illustration.

Referring to FIGS. 1–3, there are shown various views of heater module 10 which embodies the invention used to advantage. Heater module 10 includes a cylindrical heat exchange matrix 12 formed by a plurality of parallel tubes 14 through which is circulated a liquid to be heated. Tubes 14 are interconnected by a plurality of metal fins 16 which are bonded to tubes 14 to form the unitary thermally stable heat exchange matrix 12 surrounding a central cylindrical cavity 18. Flue gases produced by the products of combustion from burner 20 which is centrally located in cavity 18 are forced outwardly through the spaces 22 between fins 16 along heat exchange paths having an average length through matrix 12 which is preferably less than four times the average radius of curvature of tubes 14. Under these conditions, large quantities of heat are transferred from the flue gases to matrix 12. The liquid flowing through tubes 14 extracts heat from matrix 12 to maintain the regions of the matrix below temperatures which would cause damage to the matrix, for example, by melting the bonds between the fins 16 and the tubes 14. More specifically, if those bonds are formed by brazing steel tubes and fins with copper, all regions of the matrix brazing joints should be maintained below 1,000° F. After passing through heat exchange matrix 12, the flue gases are contained within wrapper 24 and exhausted outwardly.

Tubular burner 20 is supplied with a fuel-air mixture from any suitable source through inlet conduit 26. For example, as described in detail in U.S. Pat. No. 3,936,003, which is hereby incorporated by reference, a predetermined mixture of air and hydrocarbon gas, such as natural gas, gasoline, methane or propane may be supplied by a blower-mixer (not shown) which receives air and a regulated combustible gas and provides a mixture thereof to inlet conduit 26 at a predetermined velocity for power combustion. Although burners of various sizes can be used, burner 20 may typically have a diameter of approximately 2.25 inches and a height of 4.5 inches with a rating of between 80,000 to 120,000 BTUs per hour. If the burner is taller such as, for example, 7.5 inches, the rating may be 130,000 to 170,000 BTUs per hour. If the burner is shorter such as, for example, 3 inches, the rating may be 45,000 to 60,000 BTUs per hour. Burner 20 is fabricated from a perforated metal with the perforations 28 serving as ports through which gas to be burned issues. Perforations 28 are preferably disposed in an ordered pattern throughout the burner surface area. Each perforation may preferably have a diameter of approximately 0.027 inches and they may number 400 per square inch.

As described briefly before, the products of combustion pass from central cavity 18 through spaces 22 between fins 16 thereby transferring heat to heat exchange matrix 12. Liquid such as, for example, pure water or a mixture of water and ethylene glycol, or water and propylene glycol is circulated through tubes 24 and is heated in the heat transfer process. The heater module 10 is in recirculation series with a second heat exchanger (not shown) to which the heat from heater module 10 is transferred. The liquid entering heater module 10 is pumped into liquid input chamber 32 through water input line 30. Input chamber 32 is one of a plurality of chambers 32–37 partitioned off by baffles 40 in the donut-shaped channel or trough 42 of bottom manifold 44. Each chamber 32–37 is formed by bottom manifold 44 on the sides and bottom, baffles 40 on the ends, and bottom plate 46 on the top. As shown in FIGS. 2 and 3, bottom plate 46 has a plurality of circular apertures 48 each associated with a tube 14 which inserts therethrough to communicate with a particular chamber 32–37. Although a different number of tubes 14 and chambers 32–27 could be used, it may be preferable to have twenty-four tubes 14 so that sets of four tubes each communicate with each of six chambers 32–37 on the bottom. Top manifold 50 is divided by baffles 51 into three chambers 52 each having eight tubes associated therewith. Top manifold 50 fits over top plate which, like bottom plate, has circular apertures 48 associated with tubes 14. Accordingly, the liquid enters input chamber 32 and flows upward through the four tubes communicating therewith and enters one of the chambers 52 in the top manifold. The liquid then flows down the other four tubes communicating with that one chamber 52 and is routed back down to the bottom manifold 44. Those four downward tubes are divided into two sets of two tubes because they are associated with two different chambers 33–36. In these chambers, the liquid enters in from one of the sets of two tubes and exits through the other two tubes in that particular chamber 33–36. As a result, the liquid makes six passes through the heat exchange matrix 12 and ends up on liquid exit chamber 37 from which it is exhausted to water exit line 56. A variety of other flow paths through heat exchange matrix could be used to advantage in accordance with the invention. An ignitor 58 such as a silicon carbide ignitor is inserted through opening 60 in bottom manifold 44 to light burner 20. Also, it should be noted that although the words "top" and "bottom" have been used herein, heater module 10 will also operate in an inverted position in which case the terms would be reversed. The apparatus described heretofore has been used in the prior art.

Still referring to FIGS. 2 and 3, and also to FIGS. 5 and 6, bottom manifold 44 is defined by a central ring disk 62 surrounded by donut-shaped channel or trough 42. Disk 62 has a circular hole 65 for insertion of burner 20. A plurality of mounting tabs 64 are bonded to disk 62 by suitable means such as spot welds. In accordance with the invention, an insulating wafer 66 is inserted down over disk 62. The mounting tabs 64 insert through slots 68 in the wafer 66. Also, as shown best in FIGS. 2 and 4, wafer 66 has an edge notch 70 through which ignitor 58 protrudes. As shown best in FIG. 6, a metal cover or jacket 72 having a recessed interior closely conforming to the shape of wafer 66 encases the sides and top of the wafer 66 with the bottom of the wafer 66 seated against the disk 62. Mounting tabs 64 also insert through aligned slots 74 in jacket 72 and the portions of the respective mounting tabs 64 extending above jacket 72 are bent to a right angle against the jacket to hold it and the wafer 66 in place.

As will be described in detail later herein, the function of insulating wafer 66 is to provide a layer of thermal insulation between the hot gases in the central cavity 18 and disk 62 so as to minimize the temperature differential thereon. As such, wafer could be fabricated from a variety of thermally insulating materials which are resistant to temperatures in excess of 2,000° F. One material that exhibits favorable properties is ceramic fiber such as, for example, alumina and silica with organic binder. This material may have a tendency to chip or flake off under certain conditions and therefore, jacket 72 functions to maintain its integrity. Preferably, jacket 72 is made from stainless steel. As mentioned earlier, the shape of jacket 72 is made to tightly conform to the shape of wafer 66. The size of the wafer is generally determined by the size of disk 62. As an example of one embodiment wafer 66 may have an outer diameter of approximately 5.25 inches with 2.5 inch concentric hole 65 cut therefrom. The notch 70 for ignitor 58 is determined in size by opening 60 and may be, for example, approximately 1.5 inches wide and 0.75 inches deep. Although other thickness could be used, the thickness of wafer 66 may preferably be in the range from 0.125 to 0.25 inches. As will be described later herein, the heater module 10 is submerged in an acid solution during manufacture and although not hermetically sealed over the wafer, jacket 72 may also function to limit the amount of acid solution that is absorbed in wafer 66.

Referring to FIG. 2, and with reference to the manufacturing process, the ends of tubes 14 are flanged until their outer diameter is in intimate contact with the circular apertures respectively of bottom plate 46 and top plate 53. The disk 62 and trough 42 of the bottom manifold are manufactured by stamping a unitary piece of plate steel and then baffles 40 which align in a radial direction are connected. The stainless steel jacket 72 with wafer 66 fitted therein is inserted down over mounting tabs 64 and the tabs are bent outwardly so as to position them as far away from burner 20 as possible. The top manifold 50 and bottom manifold 44 are sized for an interference fit respectively with the top plate 53 and bottom plate 46. To make the joints water tight, the assembly is then copper plated and brazed. That is, it is heated to a temperature where the copper plating is liquid but the steel is only soft so that the copper flows into the cracks between steel parts to seal them. Further, the assembly is painted and in steps for preparation thereof, the assembly is sequentially dipped in acidic and cleaning solutions. The stainless steel jacket 72 provides some protection for limiting the absorption of solution in wafer 66 even though it doesn't provide a hermetic seal.

The addition of wafer 66 and jacket 72 to flat disk 62 substantially reduces the temperature differential or $\Delta T$ of the bottom manifold. For example, the table below presents data taken by measuring the temperature of the bottom manifold 44 at various points in a radial direction from burner hole 65 using thermocouples.

TABLE

| Distance from burner hole (inches) | Without wafer (°F.) | With wafer (°F.) |
|---|---|---|
| 0.50 | 430 | 285 |
| 1.0 | 375 | 252 |
| 1.25 | 295 | 218 |
| 1.5 (in bend) | 180 | 169 |
| 0.25 (below bend) | 160 | 160 |

The data in the Table was taken using a 0.125-inch thick wafer of FIGberfrax 55 as is commercially available from Carborundum Company. It is apparent that the measured temperatures are dependent on the material and thickness of the wafer 66, the characteristics of the heater module 10 and its operational parameters. Also, the absolute temperature taken in the trough 42 below the bend would vary depending on the angular direction on which the thermocouples were positioned because the liquid may typically enter the heater module 10 at approximately 160° F. and leave at 180° F.; if the thermocouple were placed over the liquid exit chamber 37 as opposed to the liquid input chamber 32, the measured temperature would typically vary by approximately 20° F. However, the Table is generally representative of a dramatic decrease in $\Delta T$ that would result under most operating structures and parameters from the modification of positioning a layer of insulation between cavity 18 and disk 62.

The addition of wafer 66 and the resulting decrease in $\Delta T$ on bottom manifold 44 may significantly increase the reliability of heater module 10. More specifically, during a firing cycle of burner 20, the hot products of combustion pass over disk 62 and through heat exchanger matrix 12. The disk is heated accordingly and it therefore expands. The trough 42 of bottom manifold 44 is kept relatively cool (160° F.–180° F.) by the liquid passing through chambers 32–37 and therefore expands very little with reference to the disk. Stated differently, part of the bottom manifold is in contact with hot gases when the burner operates and thus, it expands more than that part of the bottom manifold that contains liquid and therefore expands relatively little. It is noted that the thermal characteristics of top plate 53 are much different because water contacts its entire outer surface and therefore, a relatively low temperature differential is maintained.

Referring to FIG. 7, bottom plate 46 is a very rigid structural element and resists expansion of trough 42 in an outward direction. Through the restraint of bottom plate 46 and the very nonuniform heating between disk 62 and trough 42, a flex point is created in bottom manifold 44 at or near braze joint 76. The amount of strain is dependent on the amount of relative displacement between disk 62 and the top of trough 42. This displacement is governed by relatively complex thermal and mechanical considerations in the region. However, by reducing the $\Delta T$ between the disk 62 and the trough 42, the strain at braze joint 76 is reduced. It is important to reduce the strain because it could result in substantial plastic deformation at bottom manifold 44 or at braze joint 76; accordingly, because burner 20 operates noncontinuously or in an on/off mode, manifold 44 or braze joint 76 could be subject to cyclic fatigue. A failure could be manifest as a crack in the braze joint, the upper region of trough 42, or the peripheral region of disk 62. Furthermore, temperature differentials in a circumferential direction around disk 62 can cause stress. More specifically, in the region of ignitor 58 and opening 60, the heat dissipation paths are longer than in other regions. Also, although the flame temperature may be approximately 2,000° F. resulting in a temperature of approximately 1,500° F. on the inward side of ignitor 58, the outer side is somewhat shielded from thermal radiation and convection thereby resulting in a much lower temperature, such as, for example, 300° F. Accordingly, wafer notch 70 leaves uncovered the peripheral portion of disk 62 from opening 60 outwardly. This may be preferable to make the temperature differential around the circumference of disk 62 more uniform.

This concludes the description of the preferred embodiment. However, many modifications and alterations without departing from the spirit and scope of the invention will be understood to exist to those skilled in the art. Accordingly, the scope of the invention is to be limited only by the appended claims.

What is claimed is:

1. A heater module comprising:

a heat exchanger having a plurality of substantially parallel tubes surrounding a cavity, said tubes being integrally connected by metal fins, said cavity having at least one open end;

a manifold covering said at least one open end, said manifold comprising a unitary metal disk and outer annular trough, said trough communicating with said tubes for circulating a liquid therebetween;

a gas burner positioned in said cavity for providing hot gases of combustion which flow outwardly through said fins to transfer heat to said liquid in said tubes; and a layer of thermal insulation covering at least a portion of said disk to limit the temperature differential between said disk and said trough of said manifold.

2. The heater module recited in claim 1 wherein said disk and said trough are formed by stamping a unitary plate of steel.

3. The heater module recited in claim 1 wherein said layer comprises ceramic fiber and is at least partially covered by a jacket of stainless steel.

4. The heater module recited in claim 1 wherein said trough is partitioned into a plurality of chambers by radial baffles.

5. A heater module, comprising:

a substantially cylindrical heat exchanger having a concentric cavity, said exchanger comprising a plurality of axially-aligned parallel tubes integrally connected with metal fins;

first and second manifolds respectively covering the ends of said cavity, said first manifold comprising a unitary disk and peripheral annular trough, said tubes communicating with said trough wherein a liquid is circulated through said trough and said tubes;

a gas burner axially positioned in said cavity for providing hot gases or combustion which flow outwardly through spaced between said fins and said tubes of said heat exchanger to transfer heat to said liquid circulating in said tubes; and a layer of thermal insulation covering at least a portion of the side of said disk facing said cavity, said layer limiting the temperature differential between said disk and said trough to reduce cyclic fatigue of said manifold.

6. The heater module recited in claim 5 wherein said layer comprises ceramic fiber and is at least partially covered by a jacket of stainless steel.

7. The heater module recited in claim 5 wherein said trough is partitioned into a plurality of chambers by a plurality of radial baffles, each of said chambers communicating with a selective set of said tubes.

8. The heater module recited in claim 6 wherein said layer and said jacket are secured on said disk by a plurality of metal mounting tabs that are connected to said disk and insert through slots in said layer and said jacket and are bent outwardly against said jacket.

9. A heater module comprising:

a substantially cylindrical heat exchanger having an open axial region defining a central cylindrical cavity, said exchanger comprising metal fins and at least one tube in heat transfer relationship with said fins for circulating a liquid therethrough;

first and second manifolds respectively covering the ends of said central cylindrical cavity, said first manifold comprising a disk having a peripheral region bent to form an annular channel, said at least one tube communicating with said channel;

a tubular burner axially positioned in said central cylincrical cavity for providing hot gases of combustion which flow outwardly through said fins of said exchanger to transfer heat to said liquid in said at least one tube; and a layer of thermal insulation covering at least a portion of said disk on the side facing said cavity to limit the temperature differential between said disk and said channel during operation of said burner thereby limiting the cyclic fatigue of said manifold caused by noncontinuous operation of said burner.

10. The heater module recited in claim 9 wherein said layer comprises ceramic fiber and is at least partially covered by a jacket of stainless steel.

11. A heater module comprising:

a heat exchanger matrix comprising a plurality of parallel tubes substantially arranged in a circle to form a cylinder having a central cylindrical cavity, said matrix further comprising metal fins integrally connected to said tubes in heat transfer relationship therewith;

first and second manifolds respectively covering the ends of said central cylindrical cavity, said first manifold defining a disk having a central circular hole, said disk being substantially perpendicular to said tubes and having a unitary outer peripheral trough, said trough being covered with an annular apertured plate and having a plurality of baffles to form a plurality of chambers wherein said tubes are grouped into sets with each set selectively communicating through said plate apertures to one of said chambers;

a tubular burner inserted through said circular hole in said disk and being positioned axially in said central cavity for providing hot gases of combustion which flow outwardly through spaces between said fins of said matrix to transfer heat to liquid flowing through said tubes; and a layer of thermally insulating material covering at least a portion of said disk on the side facing said cavity to limit the temperature differential between said disk and said trough thereby reducing plastic deformation of said manifold caused by on/off operation of said burner.

12. A heater module comprising:

a heat exchanger matrix comprising a plurality of parallel tubes substantially arranged in a circle to form a cylinder having a central cylindrical cavity, said matrix further comprising metal fins integrally connected to said tubes in heat transfer relationship therewith;

first and second manifolds respectively covering the ends of said central cylindrical cavity, said first manifold defining a stamped plate metal structure having a substantially flat disk with a peripheral annular trough, said trough being partitioned into chambers by a plurality of radial baffles, said trough being covered by an annular plate having a plurality of circular apertures;

said tubes inserting through said apertures wherein each of said chambers communicates with a selective set of said tubes for circulating a liquid through said matrix;

said flat disk having a first hole for inserting a burner into saad cavity, said burner providing hot gases of combustion which flow outwardly from said cavity through spaces between said fins and said tubes to transfer heat to said liquid in said tubes;

said flat disk having a second hole peripherally located for inserting a burner ignitor into said cavity;

said flat disk having a plurality of mounting tabs extending into said cavity, said tabs inserting through slots in a thermally insulating wafer and its metal cover and being bent outwardly to secure said wafer and said cover in place;

said wafer and said cover having an aperture through which said burner is inserted and an edge notch through which said ignitor inserts; and said thermally insulating wafer limiting the temperature differential between said disk and said trough thereby reducing cyclic fatigue of said manifold resulting from nonuniform expansion during burner operating intervals.

* * * * *